US010797379B1

(12) United States Patent
Lee et al.

(10) Patent No.: US 10,797,379 B1
(45) Date of Patent: Oct. 6, 2020

(54) ANTENNA STRUCTURE

(71) Applicant: Quanta Computer Inc., Taoyuan (TW)

(72) Inventors: Kuan-Hsien Lee, Taoyuan (TW); Ying-Cong Deng, Taoyuan (TW); Chung-Hung Lo, Taoyuan (TW); Yi-Ling Tseng, Taoyuan (TW); Chung-Ting Hung, Taoyuan (TW); Chin-Lung Tsai, Taoyuan (TW)

(73) Assignee: QUANTA COMPUTER INC., Guishan Dist., Taoyuan (TW)

( * ) Notice: Subject to any disclaimer, the term of this patent is extended or adjusted under 35 U.S.C. 154(b) by 0 days.

(21) Appl. No.: 16/728,326

(22) Filed: Dec. 27, 2019

(30) Foreign Application Priority Data

Sep. 6, 2019 (TW) ..... 108132141 A

(51) Int. Cl.

| | |
|---|---|
| ***H04M 1/00*** | (2006.01) |
| ***H01Q 1/24*** | (2006.01) |
| ***H01Q 1/38*** | (2006.01) |
| *H01Q 9/26* | (2006.01) |

(52) U.S. Cl.
CPC ..... *H01Q 1/243* (2013.01); *H01Q 1/245* (2013.01); *H01Q 1/38* (2013.01); *H01Q 9/26* (2013.01)

(58) Field of Classification Search
CPC ..... H01Q 1/243; H01Q 1/245; H01Q 1/38; H01Q 9/26
USPC ..... 455/575.7
See application file for complete search history.

(56) References Cited

U.S. PATENT DOCUMENTS

| | | | | |
|---|---|---|---|---|
| 8,638,271 | B2 * | 1/2014 | Wang | H01Q 5/364 343/846 |
| 8,907,853 | B2 * | 12/2014 | Ying | H01Q 1/243 343/702 |
| 9,502,769 | B2 * | 11/2016 | Tsai | H01Q 5/328 |
| 9,979,074 | B2 * | 5/2018 | Chen | H01Q 5/371 |

(Continued)

FOREIGN PATENT DOCUMENTS

| | | |
|---|---|---|
| TW | M401222 U | 4/2011 |
| TW | I441388 B | 6/2014 |

OTHER PUBLICATIONS

Chinese language office action dated Apr. 16, 2020, issued in application No. TW 108132141.

*Primary Examiner* — April G Gonzales
(74) *Attorney, Agent, or Firm* — McClure, Qualey & Rodack, LLP

(57) ABSTRACT

An antenna structure includes a nonconductive supporting element, a feeding radiation element, a first radiation element, a second radiation element, a third radiation element, a fourth radiation element, and a tuning radiation element. The first radiation element is coupled to the feeding point. The second radiation element is coupled to the feeding radiation element. The third radiation element is coupled to the feeding radiation element. A slot region is formed between the second radiation element and the third radiation element. The fourth radiation element is coupled to a ground voltage. A coupling gap is formed between the fourth radiation element and the third radiation element. The tuning radiation element is coupled to the fourth radiation element. The feeding radiation element, the first radiation element, the second radiation element, the third radiation element, the fourth radiation element, and the tuning radiation element are disposed on the nonconductive supporting element.

10 Claims, 3 Drawing Sheets

(56) References Cited

U.S. PATENT DOCUMENTS

| | | | | |
|---|---|---|---|---|
| 9,992,312 | B1 * | 6/2018 | Deng | H04M 1/026 |
| 10,224,612 | B1 * | 3/2019 | Wang | H01Q 21/30 |
| 10,297,905 | B2 * | 5/2019 | Lu | H01Q 21/30 |
| 10,446,915 | B2 * | 10/2019 | Chen | H01Q 1/48 |
| 10,522,902 | B1 * | 12/2019 | Tseng | H01Q 9/42 |
| 10,559,882 | B2 * | 2/2020 | Lee | H01Q 9/42 |
| 10,727,588 | B2 * | 7/2020 | Deng | H01Q 5/40 |
| 2005/0157520 | A1 * | 7/2005 | Chuang | G02F 1/133308 362/632 |
| 2014/0347247 | A1 * | 11/2014 | Park | H01Q 21/0075 343/893 |
| 2015/0022422 | A1 * | 1/2015 | Chang | H01Q 1/243 343/861 |
| 2018/0048076 | A1 * | 2/2018 | Wei | H01Q 9/045 |
| 2018/0053990 | A1 * | 2/2018 | Caballero | H04M 1/0202 |
| 2018/0183137 | A1 * | 6/2018 | Tsai | H01Q 5/335 |
| 2018/0183147 | A1 * | 6/2018 | Ku | H01Q 1/24 |
| 2020/0067182 | A1 * | 2/2020 | Huang | H01Q 1/36 |
| 2020/0076061 | A1 * | 3/2020 | Chen | H01Q 13/106 |
| 2020/0106178 | A1 * | 4/2020 | Chou | H01Q 1/48 |

* cited by examiner

ANTENNA STRUCTURE

CROSS REFERENCE TO RELATED APPLICATIONS

This application claims priority of Taiwan Patent Application No. 108132141 filed on Sep. 6, 2019, the entirety of which is incorporated by reference herein.

BACKGROUND OF THE INVENTION

Field of the Invention

The disclosure generally relates to an antenna structure, and more particularly, it relates to a wideband antenna structure.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements for wireless communication. If an antenna used for signal reception and transmission has insufficient bandwidth, it will negatively affect the communication quality of the mobile device. Accordingly, it has become a critical challenge for antenna designers to design a small-size, wideband antenna element.

BRIEF SUMMARY OF THE INVENTION

In an exemplary embodiment, the disclosure is directed to an antenna structure which includes a nonconductive supporting element, a feeding radiation element, a first radiation element, a second radiation element, a third radiation element, a fourth radiation element, and a tuning radiation element. The feeding radiation element has a feeding point. The first radiation element is coupled to the feeding point. The second radiation element is coupled to the feeding radiation element. The third radiation element is coupled to the feeding radiation element. A slot region is formed between the second radiation element and the third radiation element. The fourth radiation element is coupled to a ground voltage. A coupling gap is formed between the fourth radiation element and the third radiation element. The tuning radiation element is coupled to the fourth radiation element. The feeding radiation element, the first radiation element, the second radiation element, the third radiation element, the fourth radiation element, and the tuning radiation element are all disposed on the nonconductive supporting element.

In some embodiments, the nonconductive supporting element has a first surface, a second surface, and a third surface. Both the first surface and the third surface are substantially perpendicular to the second surface. The feeding radiation element extends from the first surface onto the second surface. The first radiation element is disposed on the first surface. The second radiation element and the third radiation element are disposed on the second surface. The fourth radiation element and the tuning radiation element are disposed on the third surface.

In some embodiments, the feeding radiation element substantially has a straight-line shape.

In some embodiments, the second radiation element substantially has a variable-width straight-line shape.

In some embodiments, the fourth radiation element substantially has a straight-line shape with at least one chamfer angle.

In some embodiments, the antenna structure covers a first frequency band, a second frequency band, a third frequency band, a fourth frequency band, and a fifth frequency band. The first frequency band is from 600 MHz to 750 MHz. The second frequency band is from 750 MHz to 960 MHz. The third frequency band is from 1700 MHz to 1900 MHz. The fourth frequency band is from 1900 MHz to 2300 MHz. The fifth frequency band is from 2500 MHz to 2700 MHz.

In some embodiments, the length of the first radiation element is substantially equal to 0.25 wavelength of the fifth frequency band.

In some embodiments, the total length of the feeding radiation element and the second radiation element is substantially equal to 0.25 wavelength of the fourth frequency band.

In some embodiments, the total length of the feeding radiation element and the third radiation element is substantially equal to 0.25 wavelength of the second frequency band.

In some embodiments, the length of the fourth radiation element is substantially equal to 0.25 wavelength of the first frequency band.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail below.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection.

Accordingly, if one device is coupled to another device, that connection may be through a direct electrical connection, or through an indirect electrical connection via other devices and connections.

Figure 1:
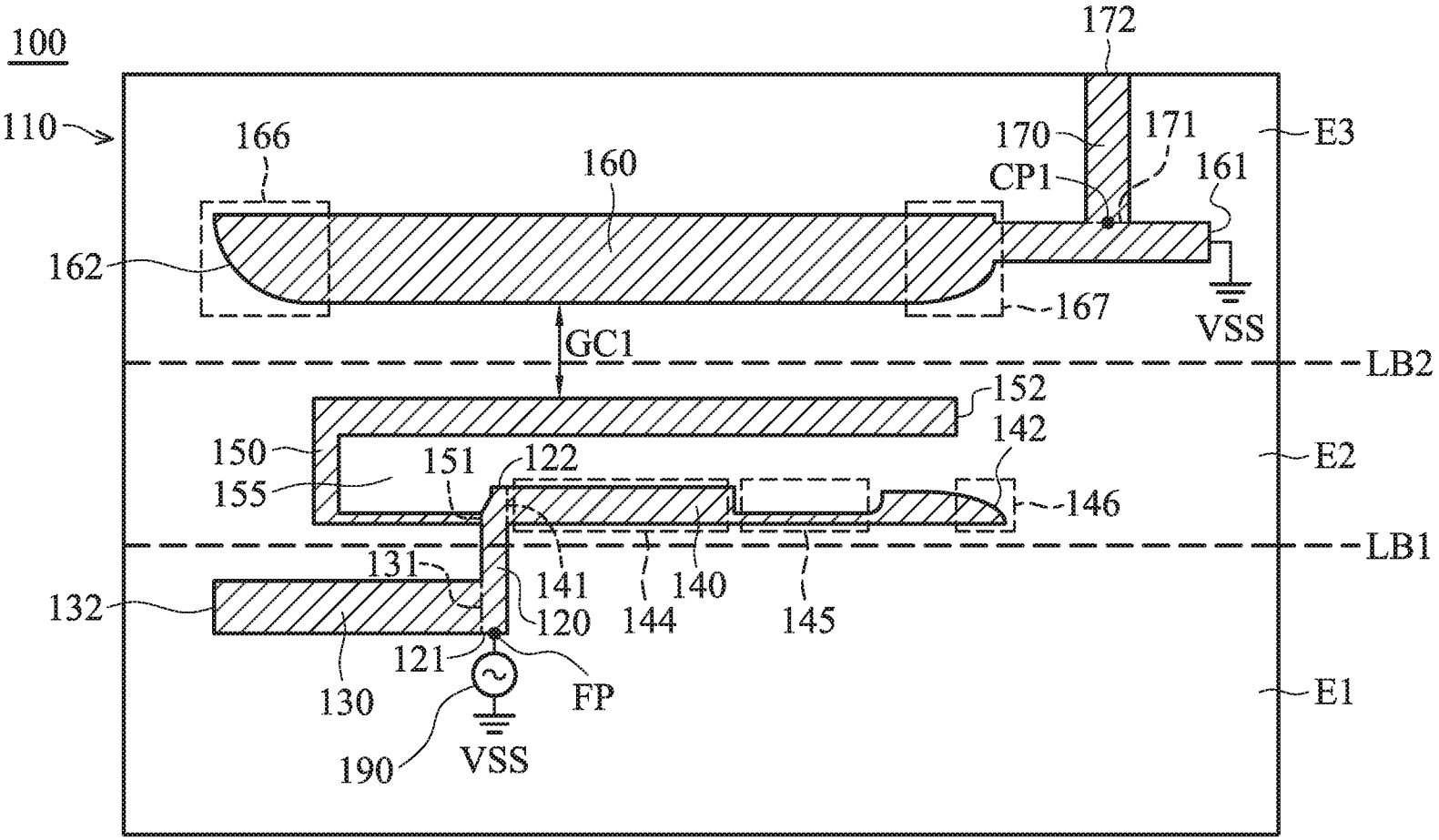
FIG. 1 is a developed view of an antenna structure according to an embodiment of the invention.
Figure 2:
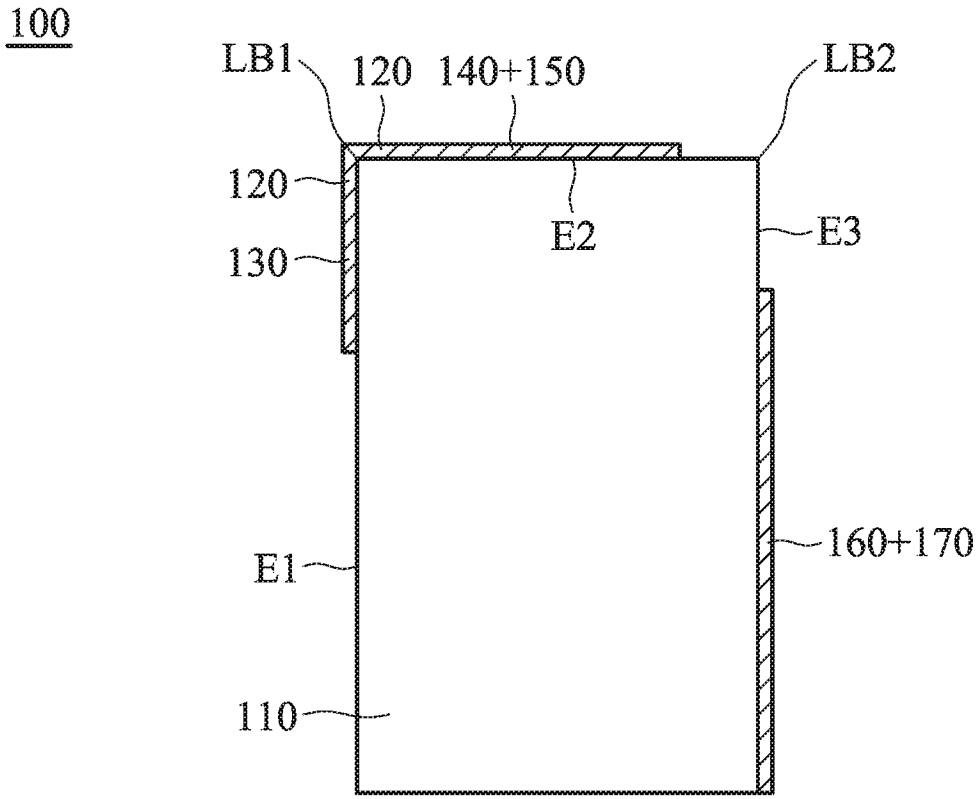
FIG. 2 is a side view of an antenna structure according to an embodiment of the invention.

FIG. 1 is a developed view of an antenna structure 100 according to an embodiment of the invention. The antenna structure 100 has two 90-degree bending lines LB1 and LB2. FIG. 2 is a side view of the antenna structure 100 according to an embodiment of the invention. Please refer to FIG. 1 and FIG. 2 together. The antenna structure 100 may be applied to a wireless access point or a mobile device, such as a smart phone, a tablet computer, or a notebook computer. As shown in FIG. 1 and FIG. 2, the antenna structure 100 at least includes a nonconductive supporting element 110, a feeding radiation element 120, a first radiation element 130, a second radiation element 140, a third radiation element 150, a fourth radiation element 160, and a tuning radiation element 170. The feeding radiation element 120, the first radiation element 130, the second radiation element 140, the third radiation element 150, the fourth radiation element 160, and the tuning radiation element 170 may all be made of metal materials, such as copper, silver, aluminum, iron, or their alloys.

The feeding radiation element 120, the first radiation element 130, the second radiation element 140, the third radiation element 150, the fourth radiation element 160, and the tuning radiation element 170 are all disposed on the nonconductive supporting element 110. Specifically, the nonconductive supporting element 110 has a first surface E1, a second surface E2, and a third surface E3. The first surface E1 and the third surface E3 are substantially parallel to each other. Both the first surface E1 and the third surface E3 are substantially perpendicular to the second surface E2. The feeding radiation element 120 extends from the first surface E1 onto the second surface E2 of the nonconductive supporting element 110. The first radiation element 130 is disposed on the first surface E1 of the nonconductive supporting element 110. Both the second radiation element 140 and the third radiation element 150 are disposed on the second surface E2 of the nonconductive supporting element 110. Both the fourth radiation element 160 and the tuning radiation element 170 are disposed on the third surface E3 of the nonconductive supporting element 110.

The feeding radiation element 120 may substantially have a straight-line shape. The feeding radiation element 120 has a first end 121 and a second end 122. A feeding point FP is positioned at the first end 121 of the feeding radiation element 120. The feeding point FP may be coupled to a signal source 190, such as an RF (Radio Frequency) module, for exciting the antenna structure 100. Specifically, the first end 121 of the feeding radiation element 120 is positioned on the first surface E1 of the nonconductive supporting element 110. The second end 122 of the feeding radiation element 120 is positioned on the second surface E2 of the nonconductive supporting element 110.

The first radiation element 130 may substantially have an equal-width straight-line shape, and it may be substantially perpendicular to the feeding radiation element 120. The first radiation element 130 has a first end 131 and a second end 132. The first end 131 of the first radiation element 130 is coupled to the feeding point FP. The second end 132 of the first radiation element 130 is an open end.

The second radiation element 140 may substantially have a variable-width straight-line shape, and it may be substantially perpendicular to the feeding radiation element 120. The second radiation element 140 has a first end 141 and a second end 142. The first end 141 of the second radiation element 140 is coupled to the second end 122 of the feeding radiation element 120. The second end 142 of the second radiation element 140 is an open end. The second end 142 of the second radiation element 140 and the second end 132 of the first radiation element 130 may substantially extend in opposite directions. In some embodiments, the second radiation element 140 includes a wide portion 144 and a narrow portion 145 which are coupled to each other. The wide portion 144 is adjacent to the first end 141 of the second radiation element 140. The narrow portion 145 is adjacent to the second end 142 of the second radiation element 140. In some embodiments, the second radiation element 140 has a chamfer angle 146 positioned at its second end 142, and the chamfer angle 146 substantially has a smooth arc-shape. Such a design can help to fine-tune the impedance matching of the antenna structure 100 and improve the device appearance of the antenna structure 100. However, the invention is not limited thereto. In alternative embodiments, adjustments are made so that the second radiation element 140 has an equal-width straight-line shape without any chamfer angle. It should be noted that the term "adjacent" or "close" over the disclosure means that the distance (spacing) between two corresponding elements is smaller than a predetermined distance (e.g., 5 mm or shorter), or it means that the two corresponding elements are touching each other directly (i.e., the aforementioned distance/spacing therebetween is reduced to 0).

The third radiation element 150 may substantially have a J-shape, and it may be at least partially perpendicular to the feeding radiation element 120. The third radiation element 150 has a first end 151 and a second end 152. The first end 151 of the third radiation element 150 is coupled to the second end 122 of the feeding radiation element 120. The second end 152 of the third radiation element 150 is an open end. The second end 152 of the third radiation element 150 and the second end 142 of second radiation element 140 may substantially extend in the same direction. In addition, a slot region 155 is formed between the second radiation element 140 and the third radiation element 150. The slot region 155 may substantially have a straight-line shape with an open side and a closed side. In alternative embodiments, adjustments are made so that the slot region 155 substantially has an L-shape.

The fourth radiation element 160 may substantially have a straight-line shape, and it may be completely separate from the feeding radiation element 120, the first radiation element 130, the second radiation element 140, and the third radiation element 150. A coupling gap GC1 is formed between the fourth radiation element 160 and the third radiation element 150. The fourth radiation element 160 has a first end 161 and a second end 162. The first end 161 of the fourth radiation element 160 is coupled to a ground voltage VSS. The second end 162 of the fourth radiation element 160 is an open end. The second end 162 of the fourth radiation element 160 and the second end 132 of the first radiation element 130 may substantially extend in the same direction. In some embodiments, the fourth radiation element 160 has a chamfer angle 166 positioned at its second end 162, and the chamfer angle 166 substantially has a smooth arc-shape. In some embodiments, the fourth radiation element 160 further has another chamfer angle 167 adjacent to its first end 161. However, the invention is not limited thereto. In alternative embodiments, adjustments are made so that the fourth radiation element 160 has an equal-width straight-line shape without any chamfer angle.

The tuning radiation element 170 may substantially have a straight-line shape, and it may be substantially perpendicular to the fourth radiation element 160. The tuning radiation element 170 has a first end 171 and a second end 172. The first end 171 of the tuning radiation element 170 is coupled to a connection point CP1 on the fourth radiation element 160. The second end 172 of the tuning radiation element 170 is an open end. The tuning radiation element 170 is configured to fine-tune the low-frequency impedance matching of the fourth radiation element 160. In alternative embodiments, the tuning radiation element 170 is removable from the antenna structure 100.

Figure 3:
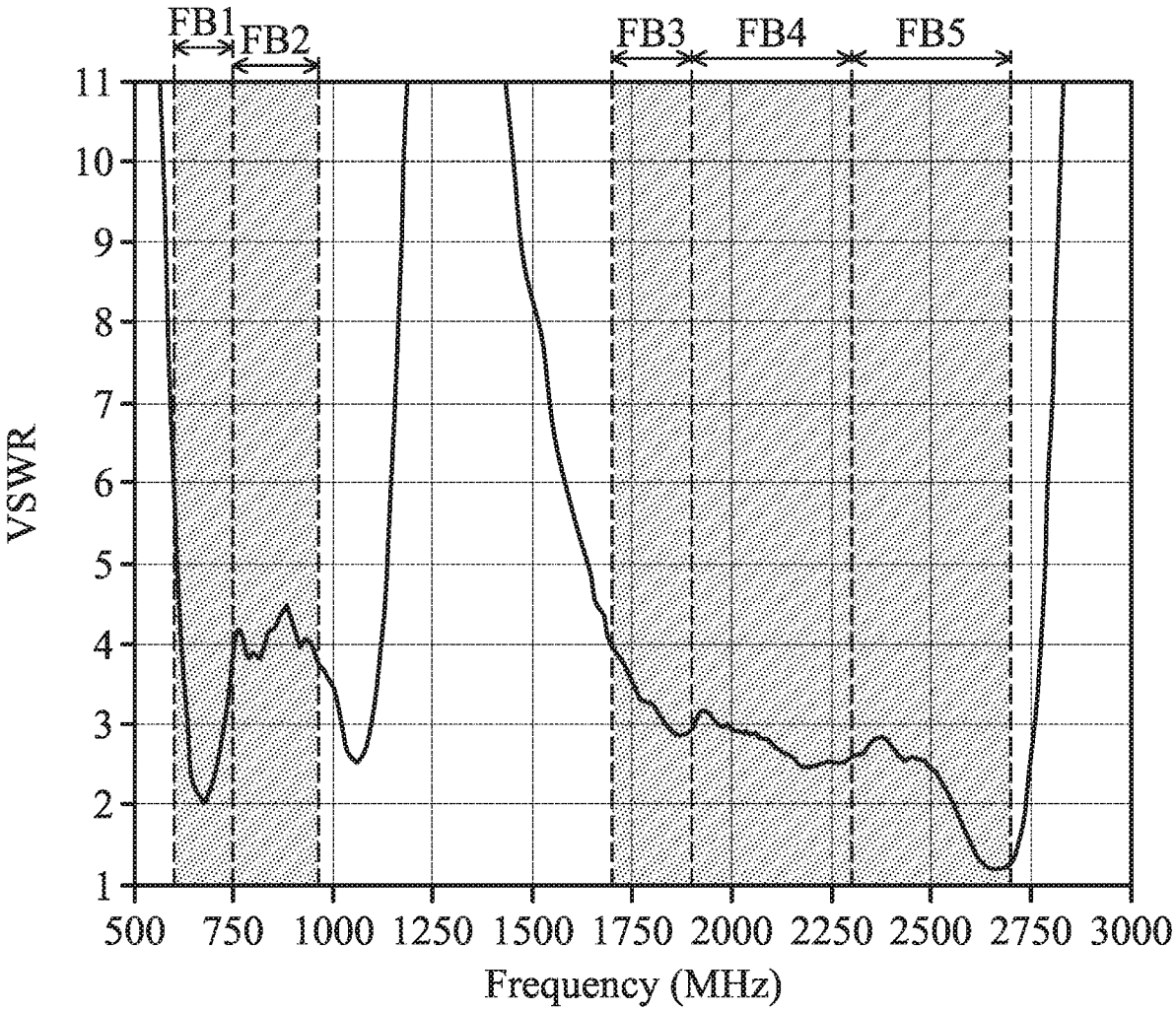
FIG. 3 is a diagram of VSWR (Voltage Standing Wave Ratio) of an antenna structure according to an embodiment of the invention.

FIG. 3 is a diagram of VSWR (Voltage Standing Wave Ratio) of the antenna structure 100 according to an embodiment of the invention. The horizontal axis represents the operation frequency (MHz), and the vertical axis represents the VSWR. According to the measurement of FIG. 3, the antenna structure 100 can cover a first frequency band FB1, a second frequency band FB2, a third frequency band FB3, a fourth frequency band FB4, and a fifth frequency band FB5. For example, the first frequency band FB1 may be from 600 MHz to 750 MHz. The second frequency band FB2 may be from 750 MHz to 960 MHz. The third frequency band FB3 may be from 1700 MHz to 1900 MHz. The fourth frequency band FB4 may be from 1900 MHz to 2300 MHz. The fifth frequency band FB5 may be from 2500 MHz to 2700 MHz. Accordingly, the antenna structure 100 can support at least wideband operations of the next-generation 5G communication.

In some embodiments, the operation principles of the antenna structure 100 are described as follows. The first radiation element 130 is excited to generate the fifth frequency band FB5. The feeding radiation element 120 and the second radiation element 140 are excited to generate the fourth frequency band FB4. The feeding radiation element 120 and the third radiation element 150 are excited to generate the second frequency band FB2. The fourth radiation element 160 is excited by the third radiation element 150 using a coupling mechanism. Specifically, the fourth radiation element 160 is excited to generate a fundamental resonant mode, thereby forming the first frequency band FB1. Furthermore, the fourth radiation element 160 is excited to generate a higher-order resonant mode, thereby forming the third frequency band FB3 (triple frequency).

In some embodiments, the element sizes of the antenna structure 100 are described as follows. The length of the first radiation element 130 (i.e., the length from the first end 131 to the second end 132) may be substantially equal to 0.25 wavelength ($\lambda/4$) of the fifth frequency band FB5 of the antenna structure 100. The total length of the feeding radiation element 120 and the second radiation element 140 (i.e., the total length from the first end 121 through the second end 122 and the first end 141 to the second end 142) may be substantially equal to 0.25 wavelength ($\lambda/4$) of the fourth frequency band FB4 of the antenna structure 100. The total length of the feeding radiation element 120 and the third radiation element 150 (i.e., the total length from the first end 121 through the second end 122 and the first end 151 to the second end 152) may be substantially equal to 0.25 wavelength ($\lambda/4$) of the second frequency band FB2 of the antenna structure 100. The length of the fourth radiation element 160 (i.e., the length from the first end 161 to the second end 162) may be substantially equal to 0.25 wavelength ($\lambda/4$) of the first frequency band FB1 of the antenna structure 100. The width of the coupling gap GC1 may be smaller than or equal to 2 mm. The above ranges of element sizes are calculated and obtained according to many experiment results, and they help to optimize the operation bandwidth and impedance matching of the antenna structure 100.

The invention proposes a novel wideband antenna structure, whose radiation elements are distributed over a 3D (Three-Dimensional) nonconductive supporting element so as to minimize the total antenna size. Generally, the invention has at least the advantages of small size, wide bandwidth, and beautiful device appearance, and therefore it is suitable for application in a variety of mobile communication devices.

Note that the above element sizes, element shapes, and frequency ranges are not limitations of the invention. An antenna designer can fine-tune these settings or values according to different requirements. It should be understood that the antenna structure of the invention is not limited to the configurations of FIGS. 1-3. The invention may merely include any one or more features of any one or more embodiments of FIGS. 1-3. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a nonconductive supporting element;

a feeding radiation element, having a feeding point;

a first radiation element, coupled to the feeding point;

a second radiation element, coupled to the feeding radiation element;

a third radiation element, coupled to the feeding radiation element, wherein a slot region is formed between the second radiation element and the third radiation element;

a fourth radiation element, coupled to a ground voltage, wherein a coupling gap is formed between the fourth radiation element and the third radiation element; and a tuning radiation element, coupled to the fourth radiation element;

wherein the feeding radiation element, the first radiation element, the second radiation element, the third radiation element, the fourth radiation element, and the tuning radiation element are all disposed on the nonconductive supporting element.

2. The antenna structure as claimed in claim 1, wherein the nonconductive supporting element has a first surface, a second surface, and a third surface, both the first surface and the third surface are substantially perpendicular to the second surface, the feeding radiation element extends from the first surface onto the second surface, the first radiation element is disposed on the first surface, the second radiation element and the third radiation element are disposed on the second surface, and the fourth radiation element and the tuning radiation element are disposed on the third surface.

3. The antenna structure as claimed in claim 1, wherein the feeding radiation element substantially has a straight-line shape.

4. The antenna structure as claimed in claim 1, wherein the second radiation element substantially has a variable-width straight-line shape.

5. The antenna structure as claimed in claim 1, wherein the fourth radiation element substantially has a straight-line shape with at least one chamfer angle.

6. The antenna structure as claimed in claim 1, wherein the antenna structure covers a first frequency band, a second frequency band, a third frequency band, a fourth frequency band, and a fifth frequency band, the first frequency band is from 600 MHz to 750 MHz, the second frequency band is from 750 MHz to 960 MHz, the third frequency band is from 1700 MHz to 1900 MHz, the fourth frequency band is from 1900 MHz to 2300 MHz, and the fifth frequency band is from 2500 MHz to 2700 MHz.

7. The antenna structure as claimed in claim 6, wherein a length of the first radiation element is substantially equal to 0.25 wavelength of the fifth frequency band.

8. The antenna structure as claimed in claim 6, wherein a total length of the feeding radiation element and the second radiation element is substantially equal to 0.25 wavelength of the fourth frequency band.

9. The antenna structure as claimed in claim 6, wherein a total length of the feeding radiation element and the third radiation element is substantially equal to 0.25 wavelength of the second frequency band.

10. The antenna structure as claimed in claim 6, wherein a length of the fourth radiation element is substantially equal to 0.25 wavelength of the first frequency band.

* * * * *